US010022997B2

(12) United States Patent
Yahata

(10) Patent No.: US 10,022,997 B2
(45) Date of Patent: Jul. 17, 2018

(54) DECOLORING APPARATUS AND SORTING METHOD FOR PAPER DISCHARGE IN DECOLORING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Isao Yahata, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/873,978

(22) Filed: Jan. 18, 2018

(65) Prior Publication Data

US 2018/0141365 A1 May 24, 2018

Related U.S. Application Data

(60) Division of application No. 15/372,456, filed on Dec. 8, 2016, now Pat. No. 9,908,357, which is a (Continued)

(51) Int. Cl.
*B41J 13/10* (2006.01)
*B41M 7/00* (2006.01)

(52) U.S. Cl.
CPC ..... *B41M 7/0009* (2013.01); *B41M 7/009* (2013.01)

(58) Field of Classification Search
CPC ..... B41J 13/0009; B41J 13/0018; B41J 13/0036; B41J 13/009; B41J 13/10; B41J 13/106; B41J 13/22; B41M 5/305; B41M 7/00; B41M 7/0009; B41M 2205/04; G03G 21/0005; G03G 21/0035; G03G 21/0047; G03G 21/0052; G03G 21/0058;
(Continued)

(56) References Cited

U.S. PATENT DOCUMENTS 8,292,287 B2 10/2012 Iguchi et al.
8,412,091 B2 4/2013 Iguchi et al.
(Continued)

OTHER PUBLICATIONS

Non-Final Office Action for U.S. Appl. No. 14/645,576 dated May 19, 2016, 23 pages.
(Continued)

*Primary Examiner* — Geoffrey Mruk
*Assistant Examiner* — Scott A Richmond
(74) *Attorney, Agent, or Firm* — Amin, Turocy & Watson LLP

(57) ABSTRACT

In accordance with one embodiment, a decoloring apparatus comprises a processor, a decoloring section, a shift roller, a paper discharge section and a paper discharge roller. The processor determines whether or not to execute either a decoloring job or a non-decoloring job. The decoloring section decolors an image on paper formed with decolorable coloring agent. The shift roller moves paper for decoloring job or paper for non-decoloring job in a direction orthogonal to a paper discharge direction of the paper on a same plane for a given distance to sort it. The paper discharge section stacks discharged papers. The paper discharge roller discharges the paper sorted by the shift roller to the paper discharge section.

5 Claims, 7 Drawing Sheets

Related U.S. Application Data continuation of application No. 14/645,576, filed on Mar. 12, 2015, now Pat. No. 9,545,809.

(58) Field of Classification Search

CPC ..... G03G 21/0064; G03G 21/007; G03G 21/0088; G03G 21/06

See application file for complete search history.

(56) References Cited

U.S. PATENT DOCUMENTS

| | | | | |
|---|---|---|---|---|
| 8,538,280 | B2 | 9/2013 | Yahata et al. | |
| 8,917,300 | B2 | 12/2014 | Arima | |
| 2001/0009625 | A1 | 7/2001 | Tamehira et al. | |
| 2006/0291018 | A1 | 12/2006 | Lang et al. | |
| 2011/0234721 | A1 | 9/2011 | Endo | |
| 2012/0146284 | A1 | 6/2012 | Dobrindt | |
| 2013/0249166 | A1* | 9/2013 | Abe | B41J 13/00 271/314 |

OTHER PUBLICATIONS

Non-Final Office Action for U.S. Appl. No. 15/372,456 dated Feb. 3, 2017, 32 pages.

Final Office Action for U.S. Appl. No. 15/372,456 dated Jun. 30, 2017, 38 pages.

U.S. Appl. No. 15/372,456, filed Dec. 8, 2016.

U.S. Appl. No. 14/645,576, filed Mar. 12, 2015.

* cited by examiner

DECOLORING APPARATUS AND SORTING METHOD FOR PAPER DISCHARGE IN DECOLORING APPARATUS

CROSS-REFERENCE TO RELATED APPLICATIONS

This application is a Divisional of application Ser. No. 15/372,456 filed on Dec. 8, 2016, which is a Continuation of application Ser. No. 14/645,576 filed on Mar. 12, 2015, the entire contents of both of which are incorporated herein by reference.

FIELD

Embodiments described herein relate generally to a decoloring apparatus and a sorting method for paper discharge in the decoloring apparatus.

BACKGROUND

In recent years, there is known a decoloring apparatus which sequentially acquires paper on the surface of which an image is formed with a coloring agent that is decolored by heat at a given temperature, and then presses and heats the paper at a high temperature such as about 180~200 degrees centigrade to carry out a decoloring processing.

A scanner is arranged inside the decoloring apparatus to read a document before the decoloring processing or to confirm a decoloring state after the decoloring processing. Thus, the decoloring apparatus may also be used as a paper reading apparatus.

However, in the conventional decoloring apparatus, it is required to equip the apparatus with a plurality of paper discharge trays to prevent, in a case of carrying out both the reading job and the decoloring job, papers for different jobs from being mixed in a same tray.

DETAILED DESCRIPTION

In accordance with one embodiment, a decoloring apparatus comprises a processor, a decoloring section, a shift roller, a paper discharge section and a paper discharge roller. The processor determines whether or not to execute either a decoloring job or a non-decoloring job. The decoloring section decolors an image on paper formed with decolorable coloring agent. The shift roller moves paper for decoloring job or paper for non-decoloring job in a direction orthogonal to a paper discharge direction of the paper on a same plane for a given distance to sort it. The paper discharge section stacks discharged papers. The paper discharge roller discharges the paper sorted by the shift roller to the paper discharge section.

Hereinafter, the embodiment of the present invention is described in detail with reference to the accompanying drawings.

Figure 1:
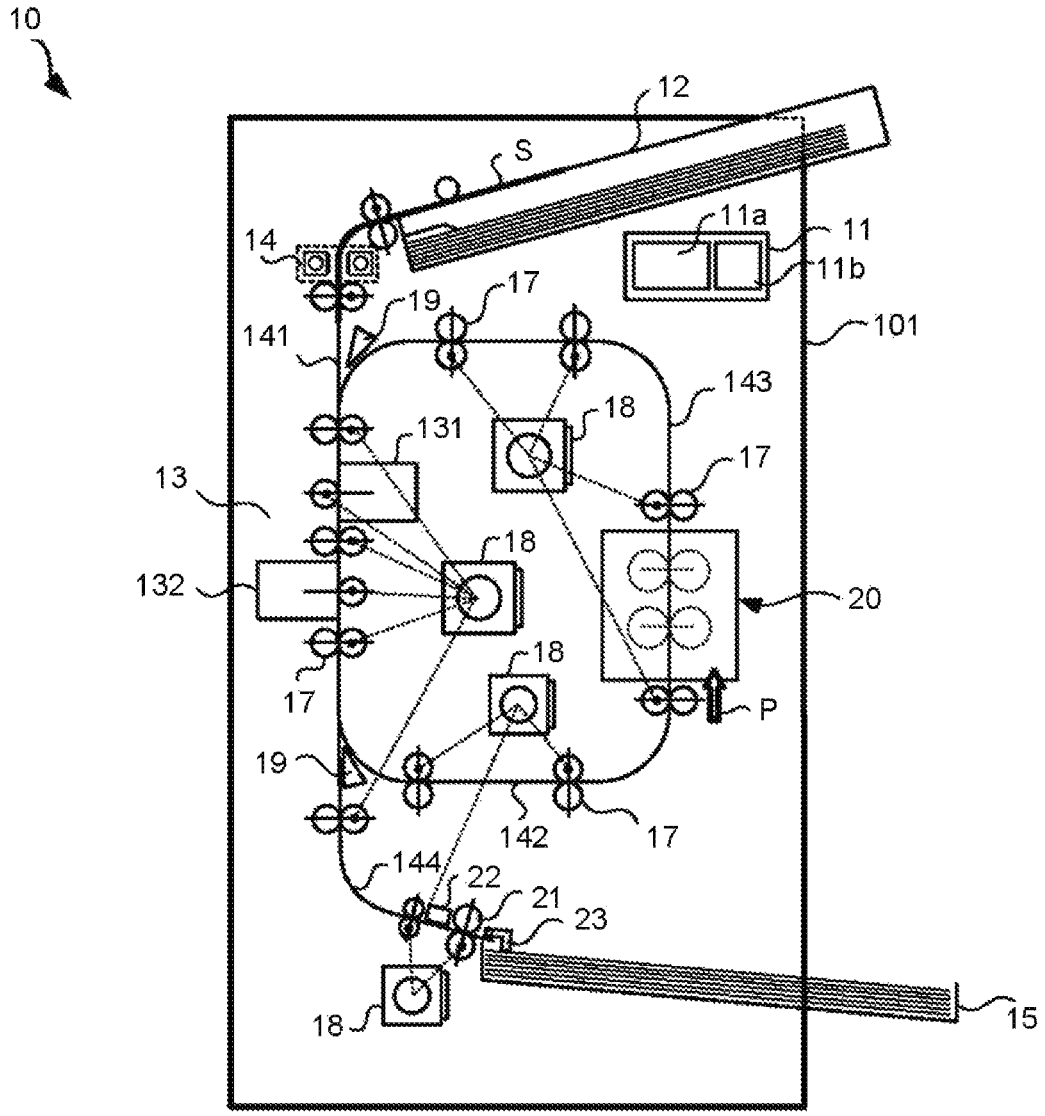
FIG. 1 is a schematic diagram illustrating an example of the whole constitution of a decoloring apparatus according to an embodiment 1.

FIG. 1 is a schematic diagram illustrating an example of the whole constitution of a decoloring apparatus 10 according to one embodiment of the present invention. The decoloring apparatus 10 comprises a control panel 11, a paper feed tray 12, a scanner 13, an ultrasonic sensor 14, a decoloring section 20 and a paper discharge tray 15.

The control panel 11 includes a display 11*a* and a touch panel 11*b* serving as an input section. The display 11*a* displays a functional menu that the decoloring apparatus 10 contains and the like, and the touch panel 11*b* is used to input a job such as a decoloring request by a user. The paper feed tray 12 stacks papers S to be subjected to reading processing or decoloring processing. The scanner 13 optically reads an image formed on the paper S when the reading job is executed or before/after the decoloring processing is executed, and stores the read image in a storage area. The scanner 13 which includes a first scanner 131 and a second scanner 132 reads two sides of the paper S. The ultrasonic sensor 14 detects a conveyance state of the paper S. The decoloring section 20 decolors an image on the paper formed with the decolorable coloring agent. In the present embodiment, the decoloring section 20 which includes a heat roller and a press roller heats and presses an image on the paper S to decolor the image. The paper discharge tray 15 is a paper discharge section used to stack the paper S subjected to the reading processing and the decoloring processing. The decoloring apparatus 10 further includes a first conveyance path 141, a second conveyance path 142, a third conveyance path 143 and a fourth conveyance path 144.

On each of the conveyance paths 141~144, a plurality of conveyance rollers 17 is arranged to convey the paper S. Each conveyance roller 17 is driven by a motor 18. On each of the conveyance paths 141~144, a plurality of gates 19 is further arranged to correctly convey the paper S to each of the conveyance paths 141~144.

The first conveyance path 141 guides the paper S acquired from the paper feed tray 12 to the scanner 13. The second conveyance path 142 guides the paper S from the scanner 13 to the decoloring section 20 in a direction indicated by an arrow P. The third conveyance path 143 guides the paper S from the decoloring section 20 to the scanner 13 again. The fourth conveyance path 144 guides the paper S from the scanner 13 to the paper discharge tray 15. Further, a shift roller 22 and a paper suppressing member 23 are arranged nearby the paper discharge roller 21. The shift roller 22 sorts papers at a predetermined position based on an input job (execution job). The paper suppressing member 23 suppresses a paper serving as a pressing target on the paper discharge tray 15 within the papers sorted by the shift roller 22.

The decoloring apparatus 10 roughly carries out the following operations (1)~(5).

(1) The scanner 13 reads image data, for example, before the image on the paper S is decolored, and meanwhile, the image data read by the scanner 13 is stored in the storage area.

(2) The paper S conveyed to the decoloring section 20 is heated and pressed when passing through the decoloring section 20. The decoloring section 20 heats and presses the paper S at a relative high temperature, for example, about 180~200 degrees centigrade to decolor the image on the paper S.

(3) The paper S passing through the decoloring section 20 is conveyed to the scanner 13 again. The scanner 13 reads the image on the paper subjected to the decoloring processing to confirm whether or not the image formed with the decolorable coloring agent in the image area is completely decolored.

(4) The image data on the paper read by the scanner 13 is analyzed to determine the decoloring state.

(5) After the paper S is sorted on the fourth conveyance path 144 based on whether the input job is a decoloring job, the paper S is discharged to the paper discharge tray 15. The paper sorting is described later in detail.

Further, the "decolor" in the present embodiment means preventing an image which is formed in a color (including not only a chromatic color but also an achromatic color such as white, black, etc.) different from the color of the base color of a paper from being seen visually. Herein, "preventing the image from being seen visually" may be a constitution in which the color of the image formed in a color different from the base color of the paper may be changed to the same color with or a similar color to the base color of the paper, in addition to a form in which the image formed in a color different from the base color of the paper becomes colorless (transparent).

Figure 2:
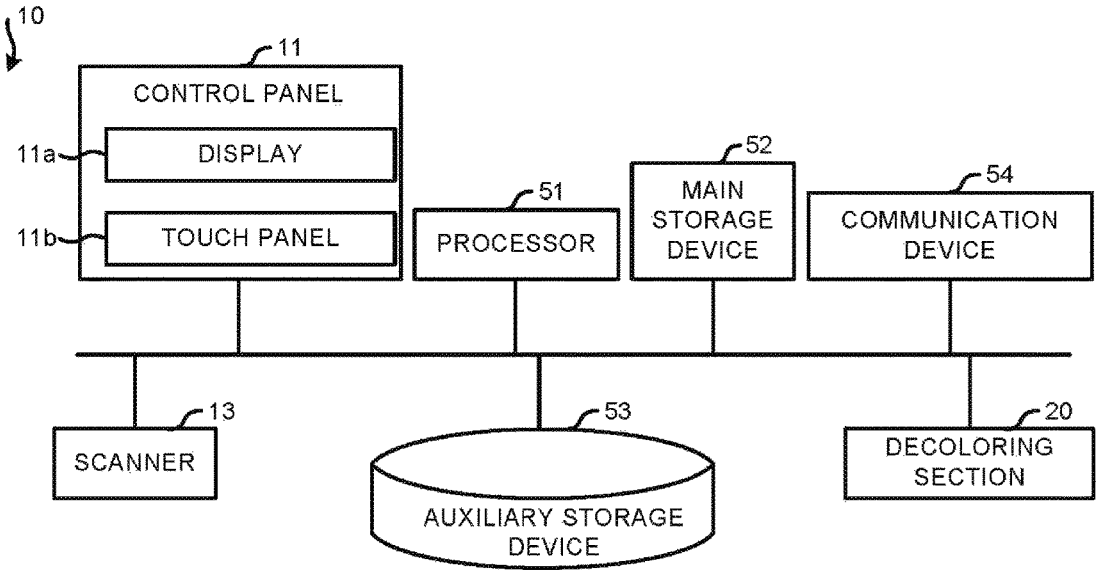
FIG. 2 is a diagram illustrating an example of the hardware constitution of the decoloring apparatus.

FIG. 2 is a diagram illustrating an example illustrating the hardware constitution of the decoloring apparatus 10. As shown in FIG. 2, the decoloring apparatus 10 comprises a processor 51, a main storage device 52, an auxiliary storage device 53 and a communication device 54, in addition to the above-mentioned control panel 11, the scanner 13 and the decoloring section 20. The processor 51 is a CPU (Central Processing Unit) which controls the whole decoloring apparatus 10. The main storage device 52 is a ROM (Read Only Memory) which stores basic programs for enabling a computer to function, environment files and the like, and a RAM (Random Access Memory) which stores programs executed by the processor 51 and data required to execute each program. The auxiliary storage device 53 is a storage device such as a HDD (Hard Disk Drive) and the like. The auxiliary storage device 53 stores data relating to the use conditions of the decoloring apparatus 10, the scan image data to be stored as the backup of a document before the decoloring processing is executed, and various programs and data operated by a control system of the decoloring apparatus 10. The communication device 54 transmits and receives information to/from a host computer (not shown in figures) connected through a network.

Figure 3:
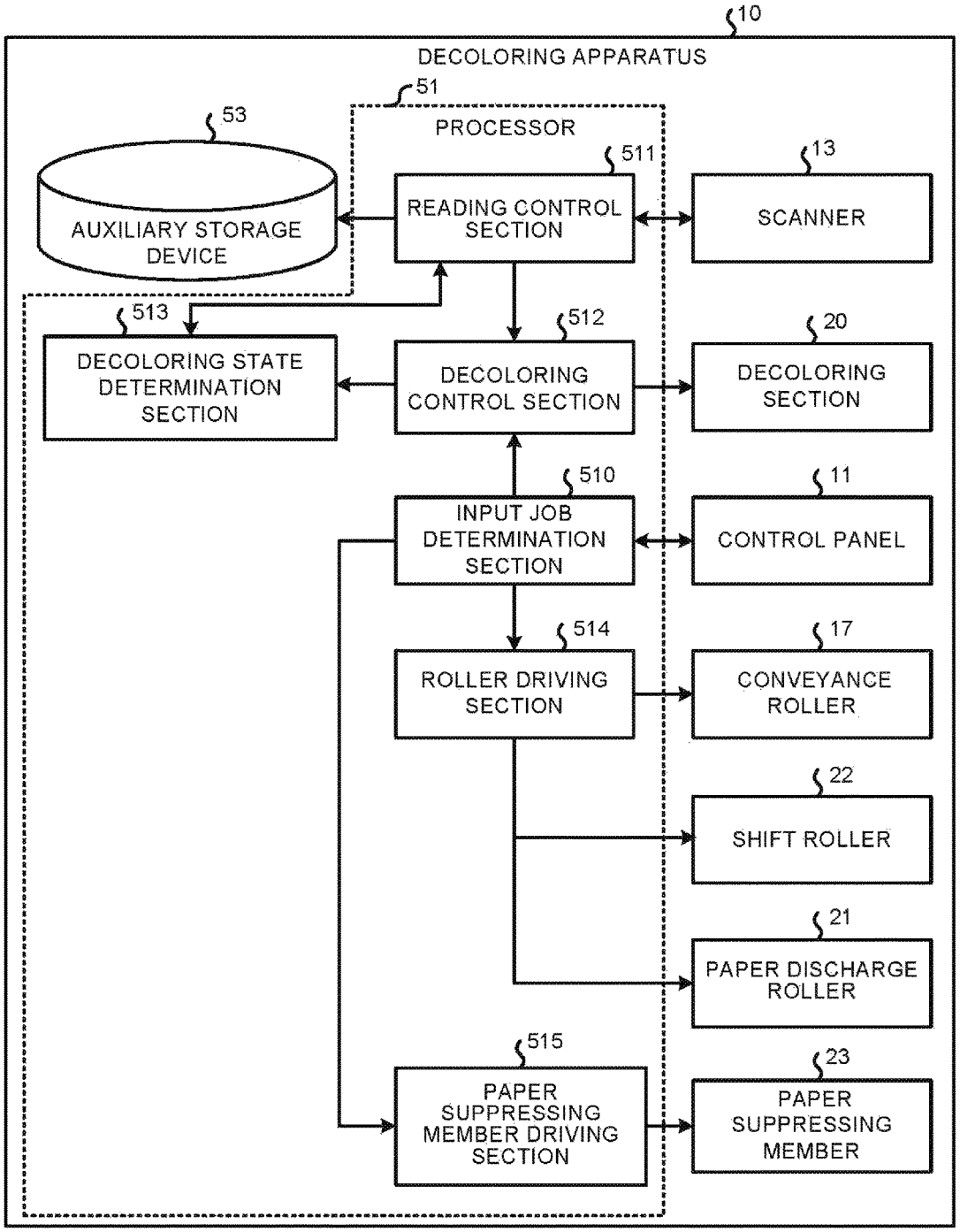
FIG. 3 is a block diagram illustrating a control system of the decoloring apparatus.

FIG. 3 is a block diagram illustrating the control system of the decoloring apparatus 10. Herein, as an example of the processor 51, an input job determination section 510, a reading control section 511, a decoloring control section 512, a decoloring state determination section 513, a roller driving section 514 and a paper suppressing member driving section 515 are represented. The input job determination section 510 acquires input and selection information in the control panel 11, and displays the execution result of jobs and error information on the control panel 11. The reading control section 511 controls a reading processing of the scanner 13 to store the image data in the auxiliary storage device 53. The decoloring control section 512 controls the driving of the heat roller and the press roller of the decoloring section 20. The decoloring state determination section 513 analyzes the image data created by the scanner 13 after the decoloring processing is carried out to determine the decoloring state of the paper. The roller driving section 514 controls energization to each of a plurality of the motors 18 to drive the conveyance roller 17, the shift roller 22 and the paper discharge roller 21. Further, the roller driving section 514 controls the driving of the shift roller 22 based on the input job (execution job). The paper suppressing member driving section 515 drives the paper suppressing member 23 in the vertical direction with respect to the surface of the paper discharge tray 15 based on the input job (execution job).

Figure 4:
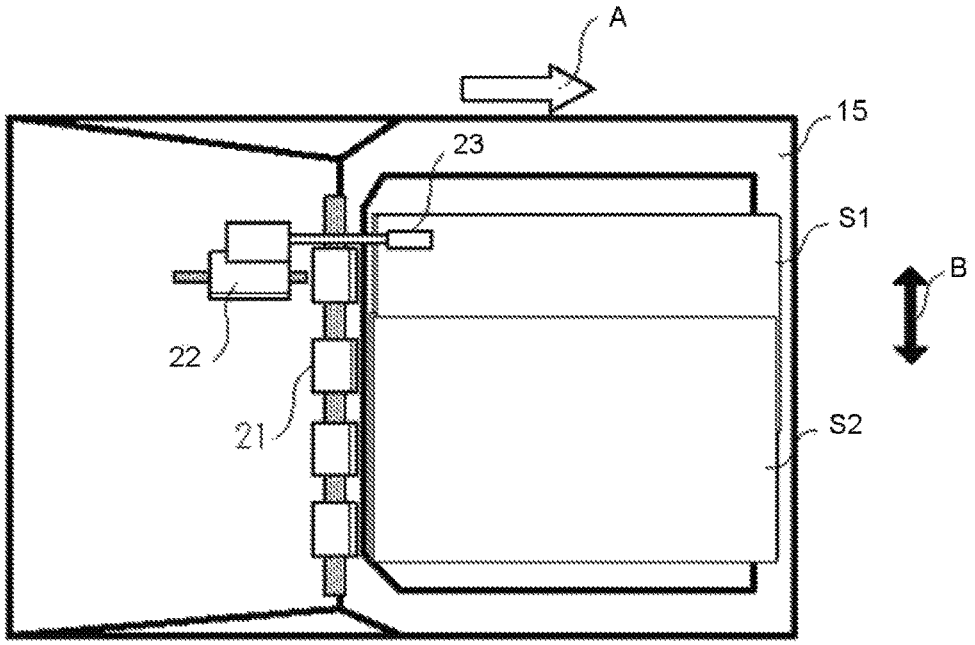
FIG. 4 is a top view illustrating a paper discharge mechanism of the decoloring apparatus.
Figure 5:
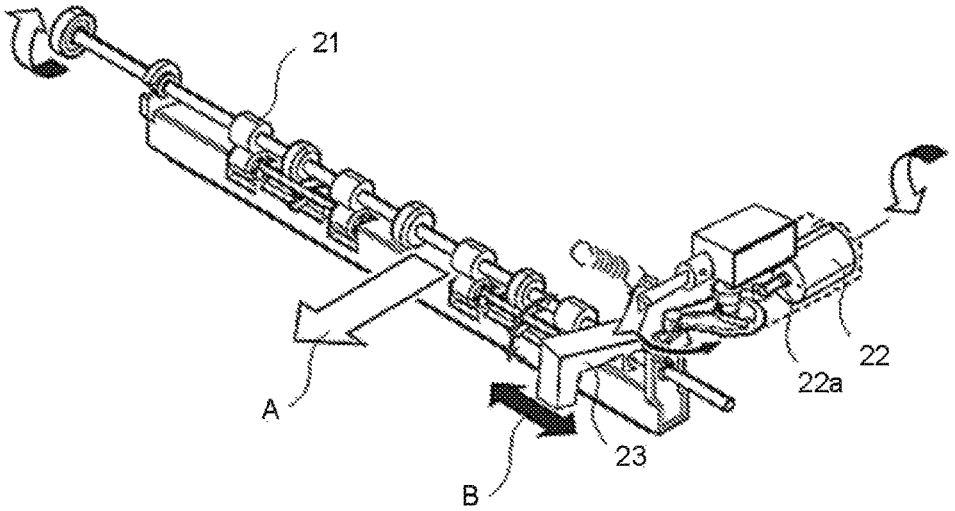
FIG. 5 is a perspective view illustrating the paper discharge mechanism of the decoloring apparatus.

FIG. 4 is a top view illustrating a paper discharge mechanism of the decoloring apparatus 10. FIG. 5 is a perspective view illustrating the paper discharge mechanism. The shift roller 22 which is equipped with a rotation shaft parallel to the paper discharge direction of the paper moves, based on the determination result of the input job, the papers for decoloring job in a direction (indicated by an arrow B) orthogonal to the paper discharge direction (indicated by an arrow A) on the same plane for a given distance to sort the papers. In other words, the shift roller 22 distributes the papers S in the horizontal direction with respect to the surface of the paper discharge tray 15 and discharges them. The paper suppressing member 23 is vertically driven in a direction orthogonal to the surface of the paper discharge tray 15 so that one area of the paper for decoloring job that is discharged in a state of being sorted by the shift roller 22 is pressed to the paper discharge tray 15. In FIG. 4, the paper for decoloring job is discharged to the machine rear side (the upper side in FIG. 4) through the driving of the paper discharge roller 21 after being sorted through the driving of the shift roller 22, and the rear end of the paper is suppressed by the paper suppressing member 23. The paper for reading job is discharged to the machine nearer side (the lower side in FIG. 4) through the driving of the paper discharge roller 21. Further, the reading job is equivalent to the non-decoloring job.

Figure 6:
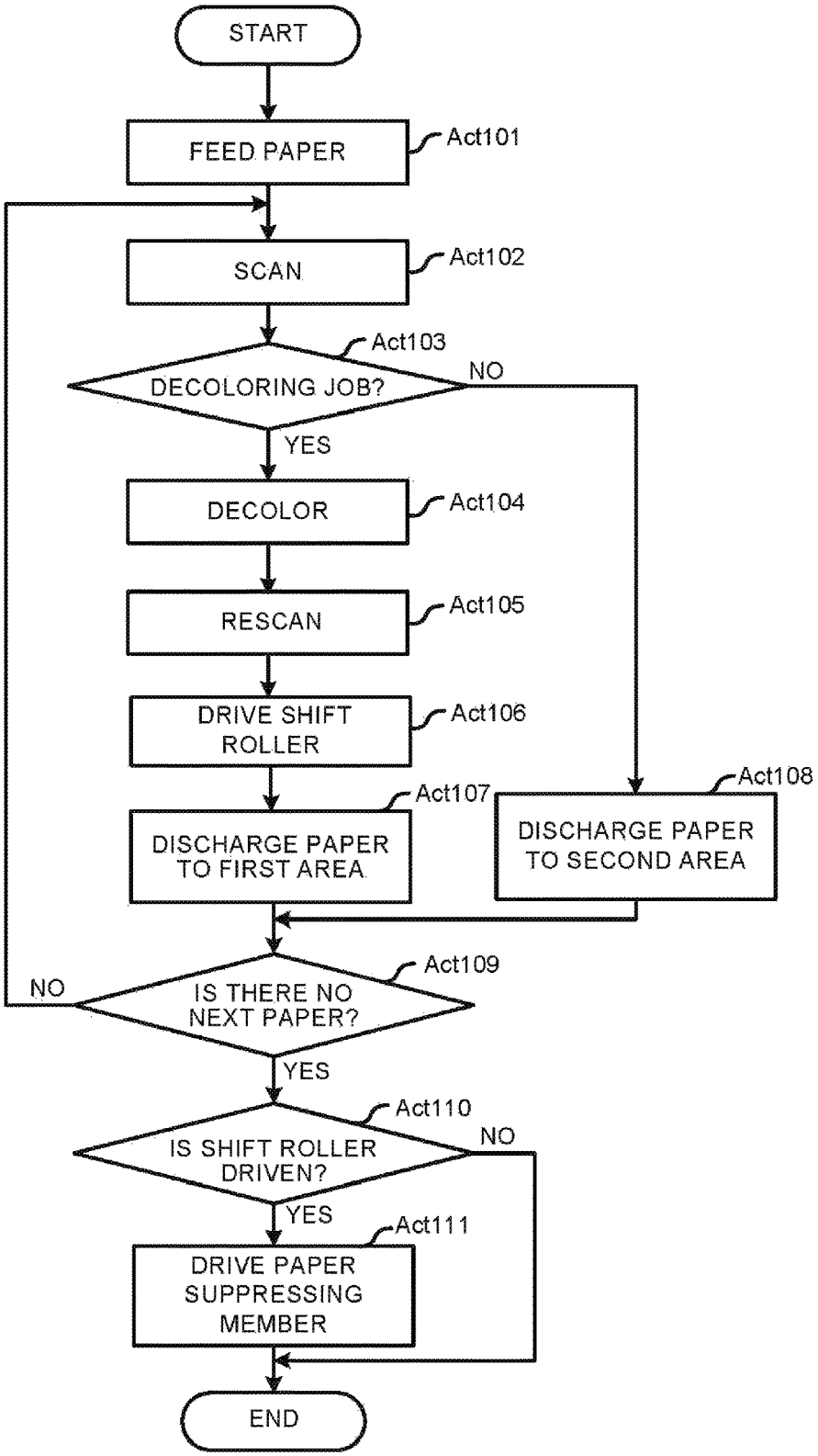
FIG. 6 is a flowchart illustrating a concrete example of the operations of the control system of the decoloring apparatus.

FIG. 6 is a flowchart illustrating a concrete example of the operations of the processor 51 of the decoloring apparatus 10.

First, the roller driving section 514 drives the conveyance roller 17 to feed the paper S stacked in the paper feed tray 12 to the first conveyance path 141 (ACT 101), and then convey the paper S to the scanner 13.

Next, the reading control section 511 drives the scanner 13 to scan the paper S (ACT 102), and meanwhile controls to store the scanned image data in the auxiliary storage device 53, and then conveys the paper S to the decoloring section 20.

Next, the input job determination section 510 determines whether or not the input job input through the control panel 11 is a decoloring job (ACT 103). Herein, if it is determined that the input job is the decoloring job (YES in ACT 103), ACT 104 is taken. On the contrary, if it is determined that the input job is a non-decoloring job (for example, reading job), ACT 108 is taken.

In ACT 104, the decoloring control section 512 controls the decoloring section 20 to decolor the paper S, and conveys the paper S to the scanner 13 again.

Next, the reading control section 511 drives the scanner 13 to rescan the paper S (ACT 105), and outputs the read image data to the decoloring state determination section 513.

Next, the roller driving section 514 rotatably drives the shift roller 22 (ACT 106) to shift the paper S for decoloring job in a direction orthogonal to the paper discharge direction for a given distance.

Then, the roller driving section 514 drives the paper discharge roller 21 to discharge the paper to a first area of the paper discharge tray 15 (ACT 107). In the present embodiment, the first area is positioned at the machine rear side (the upper side in FIG. 4).

Further, in ACT 108, the roller driving section 514 drives the paper discharge roller 21 to discharge the paper S subjected to the reading processing by the scanner 13 to a second area of the paper discharge tray 15. In the present embodiment, the second area is positioned at the nearer side of the paper discharge tray 15 (the lower side in FIG. 4).

In ACT 109, the reading control section 511 determines whether or not there is no next paper serving as a processing target. Herein, if it is determined that there is no paper serving as the processing target (YES in ACT 109), the input job is regarded as an ended job, and ACT 110 is taken. On the contrary, if it is determined that there is a paper serving as the processing target (NO in ACT 109), the processing returns to ACT 102.

In ACT 110, the paper suppressing member driving section 515 determines whether or not the shift roller 22 is driven during the execution of a same job. Further, the above-mentioned "same job" refers to one job. Herein, if it is determined that the shift roller 22 is driven (YES in ACT 110), the paper suppressing member driving section 515 drives the paper suppressing member 23 in the vertical direction to suppress the rear end of the paper S for decoloring job which is discharged to the first area (ACT 111), and then the processing is ended. On the contrary, if it is determined that the shift roller 22 is not driven, that is, the execution job is a non-decoloring job (for example, reading job) (NO in ACT 110), the paper suppressing member driving section 515 ends the processing without driving the paper suppressing member 23.

In this way, in accordance with the decoloring apparatus 10 according to the present embodiment, even if different kinds of jobs are executed for the papers on the paper feed tray 12, it is possible to sort the papers to discharge them to separated areas of the common paper discharge tray 15. Thus, the number of the paper discharge trays can be reduced, thereby miniaturizing the apparatus.

Further, since the paper for reading job is discharged to the machine nearer side (the lower side in FIG. 4) through the driving of the paper discharge roller 21, there is an advantage that the paper for reading job which is considered to have a high taking-out frequency is easy to take out.

Further, since the paper is suppressed by the paper suppressing member 23 which is positioned at the machine rear side (the upper side in FIG. 4), it is possible to restrict that the papers subjected to different jobs are mixed when taking out papers from the paper discharge tray 15.

Especially, it is preferable that the decoloring apparatus 10 is applied in the ADF (Auto Document Feeder) of the MFP.

Further, it is exemplified above that the shift roller 22 is driven to discharge the paper subjected to the decoloring job to the first area of the paper discharge tray 15, and to discharge the paper subjected to the non-decoloring job (reading job) to the second area of the paper discharge tray 15. However, the shift roller 22 may be driven to discharge the paper subjected to the non-decoloring job (reading job) to the second area, and to discharge the paper subjected to the decoloring job to the first area.

Further, whether to set the paper that is moved by the shift roller 22 or the paper that is not moved by the shift roller 22 as the pressing target may be changed arbitrarily. For example, the paper for reading job but not the paper for decoloring job may be set as the pressing target.

An Embodiment 2

The present embodiment is different from the embodiment 1 in that the decoloring apparatus 10 drives the shift roller 22 based on the determination result of the decoloring state but not the determination result of the input job. The reference numerals common to the embodiment 1 represent the same components, and therefore the description thereof is not provided.

Figure 7:
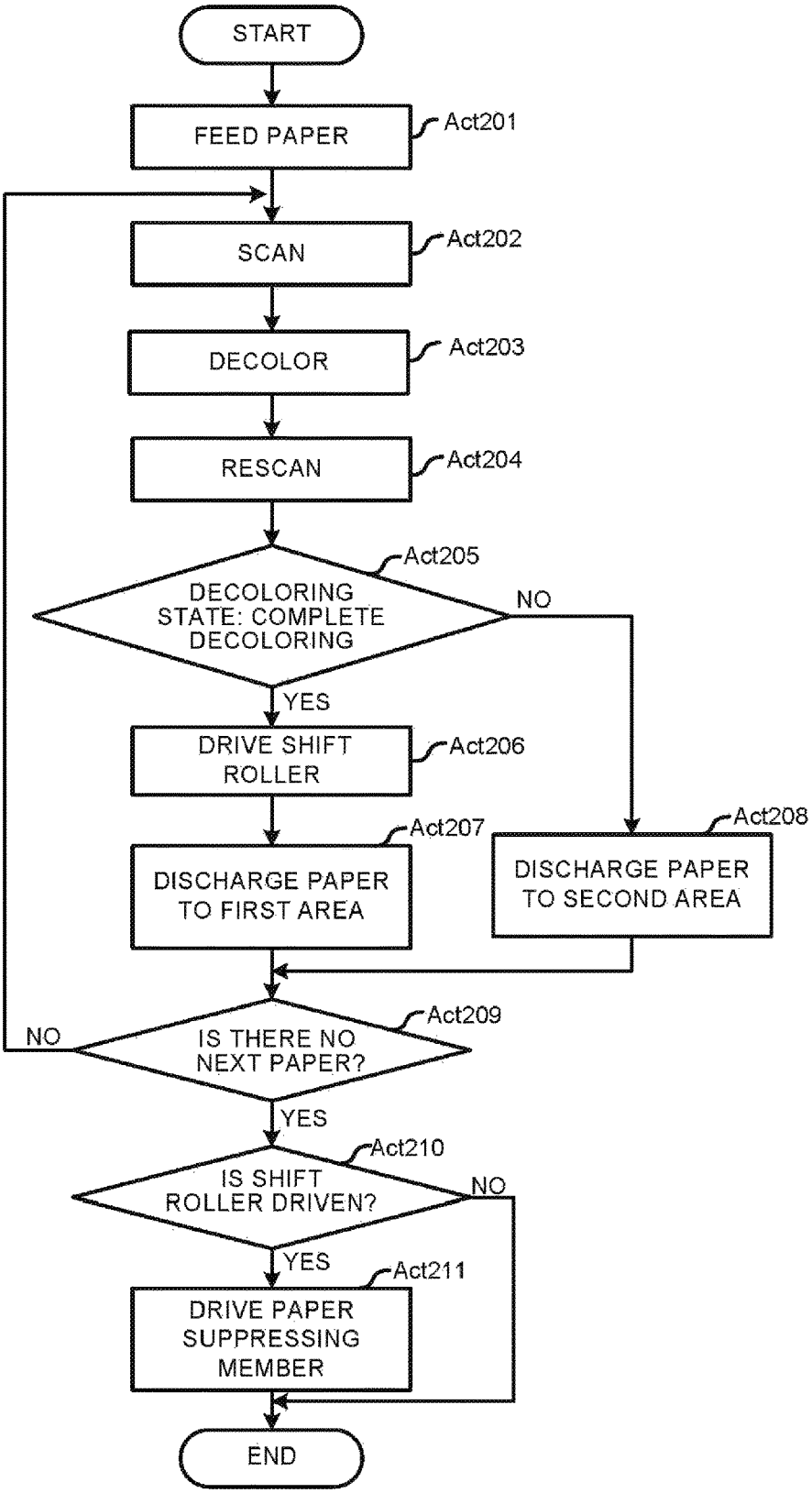
FIG. 7 is a flowchart illustrating a concrete example of the operations of a control system of a decoloring apparatus according to an embodiment 2.

FIG. 7 is a flowchart illustrating a concrete example of the operations of the processor 51 of the decoloring apparatus 10 according to the present embodiment.

First, the roller driving section 514 drives the conveyance roller 17 to feed the paper S stacked in the paper feed tray 12 to the first conveyance path 141 (ACT 201), and convey the paper S to the scanner 13.

Next, the reading control section 511 drives the scanner 13 to scan the paper S (ACT 202), and meanwhile controls to store the scanned image data in the auxiliary storage device 53, and then conveys the paper S to the decoloring section 20.

Next, the decoloring control section 512 controls the decoloring section 20 to decolor the paper S (ACT 203), and conveys the paper S to the scanner 13 again.

Next, the reading control section 511 drives the scanner 13 to rescan the paper S (ACT 204), and then outputs the read image data to the decoloring state determination section 513.

Next, the decoloring state determination section 513 analyzes the image data to determine the decoloring state of the paper S (ACT 205). Herein, if the decoloring state is determined to be complete (YES in ACT 205), ACT 206 is taken. On the contrary, if the decoloring state is determined to be incomplete (NO in ACT 205), ACT 208 is taken. Further, the "decoloring state is complete" mentioned above is not limited to a case in which the image formed on the paper is completely decolored. That is, as long as the image cannot be seen visually, the decoloring state can be determined to be complete. For example, in a case in which the number of dots on the image on the paper subjected to the decoloring processing is smaller than a predetermined number of dots, or in a case in which the image density of the image on the paper subjected to the decoloring processing does not reach a predetermined image density, the decoloring state is determined to be complete.

Further, the "decoloring state is incomplete" mentioned above is not limited to a case in which the image on the paper is not decolored completely. For example, in a case in which the number of remained dots on the image on the paper subjected to the decoloring processing exceeds a predetermined number of dots, or in a case in which the image density of the image on the paper subjected to the decoloring processing is higher than a predetermined image density, it is determined that "the decoloring state is incomplete". Further, in the present embodiment, in a case of a broken paper or a paper on which the image is formed with a color material other than the decolorable coloring agent, the decoloring state is also determined to be incomplete.

In ACT 206, the roller driving section 514 rotatably drives the shift roller 22 to move paper for only a given distance in a direction orthogonal to the paper discharge direction. Then, the roller driving section 514 discharges the paper S that is decolored completely to the first area of the paper discharge tray 15 through the paper discharge roller 21 (ACT 207).

In ACT 208, the roller driving section 514 discharges the paper S that is not decolored completely to the second area of the paper discharge tray 15 through the paper discharge roller 21.

In ACT 209, the reading control section 511 determines whether or not there is no next paper serving as a processing target. Herein, if it is determined that there is no paper serving as the processing target (YES in ACT 209), the decoloring job is regarded as an ended job, and ACT 210 is taken. On the contrary, if it is determined that there is a paper serving as the processing target (NO in ACT 209), the processing returns to ACT 202.

In ACT 210, the paper suppressing member driving section 515 determines whether or not the shift roller 22 is driven during the execution of a same decoloring job. Further, the above-mentioned "same decoloring job" refers to one group of job (one job). Herein, if it is determined that the shift roller 22 is driven (YES in ACT 210), the paper suppressing member driving section 515 drives the paper suppressing member 23 in the vertical direction to suppress the rear end of the paper S which is decolored completely and discharged to the first area (ACT 211). On the contrary, if it is determined that no paper is discharged to the second area, that is, all papers are decolored completely (NO in ACT 210), the paper suppressing member driving section 515 ends the processing without driving the paper suppressing member 23.

In this way, in accordance with the decoloring apparatus 10 according to the present embodiment, it is possible to sort the papers that are different in the decoloring state to discharge them to separated areas of the common paper discharge tray 15. Thus, the number of the paper discharge trays can be reduced, thereby miniaturizing the apparatus.

Further, since the paper is suppressed by the paper suppressing member 23 which is positioned at the machine rear side (the upper side in FIG. 4), it is possible to restrict that the papers subjected to different jobs are mixed when taking out papers from the paper discharge tray 15. Especially, since the paper decolored completely is suppressed by the paper suppressing member 23 in the paper discharge tray 15, it is possible to easily take out the paper that cannot be reused and is in an incomplete decoloring state.

(Modifications)

Hereinafter, several modifications of the embodiments described above are described. In the embodiment 2 described above, in a case where the decoloring state is complete, the shift roller 22 is rotatably driven. However, the rotation direction of the shift roller 22 may be reversed based on the decoloring state so that the shift roller 22 can sort papers in two directions.

In the embodiment 2 described above, in a case where the shift roller 22 is driven more than one time in a same decoloring job, the paper suppressing member 23 is driven. However, the paper suppressing member 23 may be driven every time the shift roller 22 is driven to sort papers. For example, the paper suppressing member 23 may be driven every time the paper that is decolored completely is discharged. Further, whether to set the paper that is moved by the shift roller 22 or the paper that is not moved by the shift roller 22 as the pressing target may be changed arbitrarily. For example, the paper of which decoloring state is determined to be incomplete rather than the paper of which the decoloring state is determined to be complete may be set as the pressing target.

Figure 8:
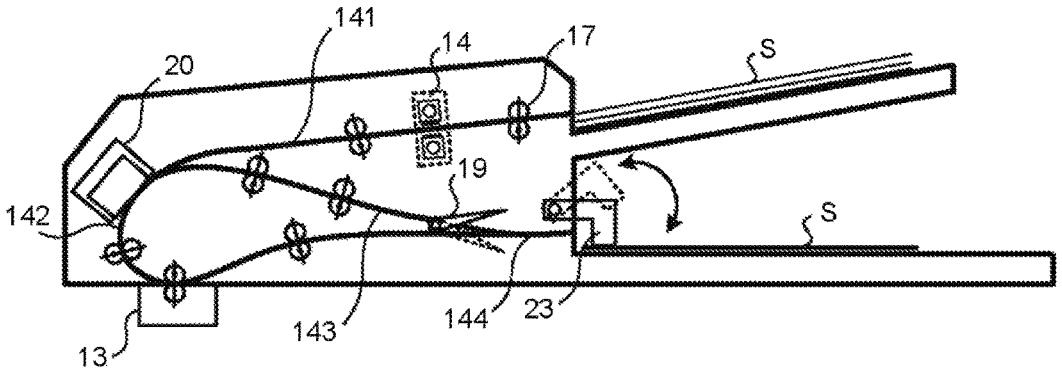
FIG. 8 is a schematic diagram illustrating an example of the whole constitution of a decoloring apparatus according to a modification of the embodiment 1.

FIG. 8 is a schematic diagram illustrating an example of the whole constitution of the decoloring apparatus 10 according to a modification of the one embodiment. Herein, the decoloring section 20 is arranged at the upstream side in the paper conveyance direction, and the scanner 13 is arranged at the downstream side in the paper conveyance direction. In this case, the shift roller 22 is driven according to whether the input job input through the control panel 11 is a reading job or a decoloring job, but not the decoloring state. It is possible to sort the paper for reading job and the paper for decoloring job through the shift roller 22, and to discharge them to the paper discharge tray 15. It is also applicable in a case of not storing the image on the paper before the decoloring processing is carried out.

Further, the "decoloring of the decoloring section" in the present embodiment is not limited to a processing of decoloring an image formed with a color different from the color of the base color of the paper through heat. For example, it may also be a processing of decoloring an image on a sheet through irradiation of light, or a processing of decoloring an image formed on a particular sheet. Or, it may also be a processing of removing (decoloring) an image on a sheet. That is, the "decoloring" refers to a processing that makes an image on a sheet invisible so that the sheet can be reused.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A sorting method for paper discharge in a decoloring apparatus, including:

determining whether or not to execute either a decoloring job or a non-decoloring job;

decoloring an image on paper formed with decolorable coloring agent;

driving a shift roller which includes a rotation shaft parallel to a paper discharge direction of the paper to move paper for the decoloring job or paper for the non-decoloring job in a direction orthogonal to the paper discharge direction of the paper on a same plane for a given distance to sort it; and discharging the paper sorted by the shift roller to a paper discharge section.

2. The sorting method for paper discharge in the decoloring apparatus according to claim 1, further including:

controlling, based on the decoloring job or the non-decoloring job, a paper suppressing member that is driven vertically in a direction orthogonal to the surface of the paper discharge tray to press one area of a paper for the decoloring job or a paper for the non-decoloring job to the paper discharge tray.

3. The sorting method for paper discharge in the decoloring apparatus according to claim 2, wherein in a case in which the shift roller is driven during the execution of the same decoloring job or the non-decoloring job, the paper suppressing member is driven when the decoloring job or the non-decoloring job is ended.

4. The sorting method for paper discharge in the decoloring apparatus according to claim 2, wherein every time the shift roller is driven during the execution of the same decoloring job or the non-decoloring job, the paper suppressing member is driven.

5. The sorting method for paper discharge in the decoloring apparatus according to claim 2, further including:

before the image is decolored, reading the image data on the paper by the scanner and storing the read image data in a storage area.

* * * * *